US005443043A

United States Patent [19]

Nilsson et al.

[11] Patent Number: 5,443,043

[45] Date of Patent: Aug. 22, 1995

[54] INTERNAL COMBUSTION ENGINE WITH VARIABLE COMPRESSION, PROVIDED WITH REINFORCEMENTS OF THE CRANKCASE SECTION

[75] Inventors: Per-Inge Nilsson, Vagnhärad; Lars Bergsten, Järna, both of Sweden

[73] Assignee: Saab Automobile Aktiebolag, Trollhattan, Sweden

[21] Appl. No.: 70,354

[22] PCT Filed: Dec. 3, 1991

[86] PCT No.: PCT/SE91/00818

§ 371 Date: Jun. 3, 1993

§ 102(e) Date: Jun. 3, 1993

[87] PCT Pub. No.: WO92/09799

PCT Pub. Date: Jun. 11, 1992

[30] Foreign Application Priority Data

Dec. 3, 1990 [SE] Sweden ..... 9003835

[51] Int. Cl.[6] ..... F02B 75/04

[52] U.S. Cl. ..... 123/48 C; 123/195 H

[58] Field of Search ..... 123/195 H, 48 R, 48 C, 123/48 D, 78 R, 78 C, 78 D, 78 F, 52 M

[56] References Cited

U.S. PATENT DOCUMENTS

| | | | |
|---|---|---|---|
| 2,770,224 | 11/1956 | Ericson | 123/52 M |
| 3,633,552 | 1/1972 | Huber | 123/48 B |
| 4,189,193 | 2/1980 | Schumaker | 123/195 H |
| 5,025,757 | 6/1991 | Larsen | 123/78 R |
| 5,218,938 | 6/1993 | Miller et al. | 123/195 H |
| 5,222,467 | 6/1993 | Sasada | 123/195 H |

FOREIGN PATENT DOCUMENTS

| | | | |
|---|---|---|---|
| 0426540 | 5/1991 | European Pat. Off. | 123/48 B |
| 0022030 | 2/1985 | Japan | 123/48 C |
| 0005100 | 2/1912 | United Kingdom | 123/48 C |

*Primary Examiner*—Tony M. Argenbright
*Assistant Examiner*—M. Macy
*Attorney, Agent, or Firm*—Ostrolenk, Faber, Gerb & Soffen

[57] ABSTRACT

An internal combustion engine with variable compression which includes a cylinder receiving section which is tiltably mounted to a crankcase section (4) of the engine, and a crankshaft (12) which is mounted in the crankcase section via crankshaft bearings (90) arranged in the lower region of the crankcase section (4). The crankshaft bearings incorporate bearing caps (102) which constitute continuous stiffening transverse connecting elements between the lower later parts (103,106) of the crankcase section. These transversely connecting bearing caps rest at their outer ends (108, 110) against internal surface areas in the lower lateral parts (104, 106) of the crankcase section on both sides of the engine. The bearing caps (12) are secured in the crankcase section (40) not only by means of vertical crankshaft bearing screws (112, 114) but also by means of screwed joints (166, 118, 120) which connect the lower lateral parts to the outer ends (108, 110) of the bearing caps.

6 Claims, 5 Drawing Sheets

INTERNAL COMBUSTION ENGINE WITH VARIABLE COMPRESSION, PROVIDED WITH REINFORCEMENTS OF THE CRANKCASE SECTION

BACKGROUND OF THE INVENTION

This invention relates to an internal combustion engine and, more particularly, to an internal combustion engine having a cylinder section which may be pivoted with respect to the crankcase section thereof to vary the compression ratio of the engine.

An in-line engine of the above type has a cylinder receiving section (a cylinder block) which is connected tiltably to the crankshaft supporting crankcase section of the engine by a hinge shaft bearing arrangement connecting the parts on one side of the engine. The cylinder receiving section supports a cylinder head which forms the cylinder head of the engine. On the other side of the engine there is a tilting mechanism arranged between the cylinder receiving section and the crankcase section, with which mechanism the cylinder receiving section and the cylinder head connected to it can be inclined laterally relative to the crankcase section.

Because the cylinder receiving section can be inclined (tilted) relative to the crankcase section, the distance between the crankshaft (with adhering pistons) and the cylinders will be variable. The volume of that part of the combustion chamber which is located above the upper limiting surface of the respective pistons, in the upper turning position of the piston (upper dead centre) can therefore be increased by the lateral inclination of the cylinder receiving section relative to the crankcase section. This means that the compression ratio of the engine will be variable, enabling the efficiency of the engine to be optimized for varying driving loads, which results in improved engine performance.

The tilting shaft bearing arrangement between the crankcase section and the cylinder receiving section is, as already mentioned, arranged on one side of the engine, while the tilting mechanism with which the cylinder receiving section can be inclined relative to the crankcase section is arranged on the opposite side of the engine. The tilting shaft bearing arrangement suitably incorporates a lateral inclination shaft which runs parallel with the crankshaft and which is housed in axially separated bearing brackets, which are rigidly connected to the crankshaft section and are positioned in line with each other along the outside of the cylinder receiving section, preferably in its lower region. In the intervals between the bearing brackets are situated bearing lugs in the cylinder receiving section mounted on the sections of the lateral inclination shaft located there. The tilting shaft bearing arrangement therefore consists of the bearing brackets, the lateral inclination shaft and the bearing lugs, which together form a type of longitudinal hinge mechanism between the crankcase section end the cylinder receiving section.

The tilting mechanism on the opposite side of the engine may, for example, incorporate essentially vertically directed rods resembling connecting rods, whose upper ends are swivelled on an upper bearing shaft parallel to the crankshaft and passing along the cylinder receiving section. The lower ends of the rods may then be eccentrically mounted on an eccentric shaft, which is in turn swivelled in bearing brackets rigidly connected to the crankcase section. The upper bearing shaft is in this case supported in the upper region of the cylinder receiving section by means of bearing brackets which are rigidly connected to the cylinder receiving section. The distance between the upper bearing shaft and the bearing brackets housing the eccentric shaft in the crankshaft section may therefore be varied by rotating the eccentric shaft. By varying this distance this side of the cylinder receiving section can be raised (or lowered) relative to the crankcase section, which gives rise to lateral inclination/tilting of the cylinder receiving section relative to the crankcase section.

The bearing brackets connected to the crankcase section for the lateral inclination shaft on one side of the engine, and the bearing brackets similarly connected to the crankcase section for the eccentric shaft, on the other side of the engine, are suitably positioned in pairs in planes between the cylinders perpendicular to the crankshaft, to increase stability. Consequently each pair of bearing brackets arranged opposite each other in the transverse direction of the engine may constitute integral parts of a common "transverse frame" of the crankcase section, which enables the crankcase to be dimensioned rationally, from the point of view of design and strength, to absorb the relatively large forces and moments applied to the crankcase section from the cylinder receiving section via the tilting shaft bearing arrangement and tilting mechanism respectively, particularly when combustion is taking place in the engine cylinders.

The transverse frame mentioned, or the bearing bracket sections of the crankcase section will, during combustion in the cylinders, be subjected to vertically upwardly directed tensile forces from the cylinder receiving section. These forces are then applied to the respective transverse frames in the form of upwardly directed forces concentrated on both the lateral inclination shaft bearing and on the eccentric shaft bearing in the frame.

Since both the lateral inclination shaft and the eccentric shaft are located laterally outside the cylinder receiving section, for design reasons, the upwardly directed forces applied to each such bearing bracket section (transverse frame) will attack the section at a considerable distance from the longitudinal centre plane of the engine in which the crankshaft is located. This means that the bearing bracket section has its maximum bending moment stress concentrated in one point in the aforementioned centre plane, which lies roughly in the centre of that part of the section/frame which is located immediately above the crankshaft. This part may then be regarded as a beam web bending moment loaded by upwardly directed end forces, i.e. the maximum compressive stresses caused by the bending moment at the upper limit (edge) of this web section occur in the aforementioned longitudinal centre plane, whilst the maximum tensile stresses occur at the lower limit of the web section, i.e. at the top of the inlet port for the crankcase in the frame. The above may be expressed by stating that the bearing brackets, because of their location a relatively long lateral distance from the centre plane of the engine, cause relatively large vertical forces to act on the crankcase section at a lateral distance from the centre plane of the engine, which results in considerable stresses in the crankcase section, and particularly in the region of the crankshaft bearings located at that point.

The above-mentioned bending moment caused by the upwardly directed forces, at the lateral inclination shah and eccentric shah respectively, also gives rise to a corresponding deflection of the lower lateral parts of the crankcase section, in the lateral direction, away from the longitudinal centre plane of the engine.

In order to reduce the maximum compressive and bending stresses in the transverse frame are above the crankshaft, and to limit the lateral deflection of the lower lateral parts of the crankcase section, it will therefore be necessary to make the crankcase section, and particularly its bearing bracket sections, much stronger, relatively speaking, than would be required in a convention, in-line engine design in which the cylinder block and the crankcase section are integrated to form a fixed unit, i.e. to form an engine block. In dimensioning such a conventional in-line engine there are of course no problems with upwardly directed forces generating bending moments at a tilting shaft bearing or tilting mechanism because the cylinder receiving section or the cylinder block is not in this case tiltably mounted on the crankshaft section but is rigidly connected to the same. On the other hand the conventional in-line engine does not provide the possibility of varying the engine compression, which is of course a particular objective of an internal combustion engine of the type indicated in the introduction.

As an example of prior art in this field it can be mentioned that U.S. Pat. No. 2,770, 224 describes and illustrates a multiple cylinder overhead valve engine in which a cylinder receiving section, with associated cylinder head/cover, is pivotably hinged to a stationary crankcase section. The cylinder receiving section of the engine can in this case be inclined (tilted) laterally relative to the crankcase section about a longitudinal guide shaft (lateral tilting shaft) on one longitudinal side of the engine.

This known engine is therefore of the type indicated in the introduction, in which the compression can be varied by inclining the cylinder receiving section relative to the crankcase section.

However, an obvious disadavantage of this known engine, with variable compression, is that the lower lateral parts of the crankcase section will be laterally deflected because of the bending moment to which the crankcase section is subjected as a result of the upwardly directed forces at the lateral tilting shaft and at the force transmitting parts of the tilting mechanism on the opposite side of the engine.

SUMMARY OF THE INVENTION

The invention eliminates the above-mentioned disadvantages of high compressive and bending stresses in the crankcase section in the area above the crankshaft and the crankshaft bearings located there, and of, considerable lateral deflections in the lower lateral parts of the crankcase section.

A further feature, relating to this, is to design the central web section of the transverse plane (the bearing bracket section) as thin as possible to minimize the overall engine height, which is always required to be as low as possible due to the confined space, among other things.

The above-mentioned features are achieved according to the invention by an internal combustion engine having a crankcase section with upper and lower portions, the lower portion having opposed first and second lateral parts having respective first and second opposed inner surfaces. A cylinder section is pivotally mounted on the crankcase section at the upper portion thereof. Bearing means are provided for mounting a crank shaft to the crankcase section at the lower portion thereof between the opposed inner surfaces of the lateral parts. The bearing means includes bearing cap means located beneath the crankshaft and extending transversely thereof to first and second end elements in contact respectively with the first and second inner opposing surfaces. Vertically extending fastening means are provided for securing the bearing cap means to the crankcase section and horizontally extending fastening means are provided for fastening the first and second end elements of the bearing cap means to the opposed inner surfaces of the lateral parts of the lower portion of the crankcase section.

The basic concept of the invention may therefore be said to be that of designing and securing the crankshaft bearing caps so that effective reinforcement of the crankcase section is achieved in the transverse direction by means of the bearing caps. Essentially this is achieved by designing the crankshaft bearing caps as transverse connecting elements whose outer ends rest against the lower lateral parts of the crankcase section, these lower lateral parts being connected to the outer ends of the bearing caps resting against them by screwed joints directed in the transverse direction of the engine.

In this case the vertical crankshaft bearing screws mounted on each side of the crankshaft and the screwed joints acting in the transverse direction of the engine for each bearing cap may be suitably located in the common vertical plane perpendicular to the crankshaft.

What is achieved with the design according to the invention, among other things, is that the transversely directed screwed joints or fixing screws at the ends of the bearing caps give rise to an effective contraction of the crankshaft supporting part of the crankcase section to form a physically closed structure around the crankshaft.

BRIEF DESCRIPTION OF THE DRAWINGS

The invention will now be: described and explained in more detail with reference to the embodiments illustrated in the attached drawings.

In the figures in the drawings.

DESCRIPTION OF THE PREFERRED EMBODIMENT(S)

The invention is now described below with reference to a four-cylinder in-line engine of the Otto type, which is designed for use as a driving engine for a passenger car, for example.

The engine described and shown has overhead camshafts and is designed so that the compression ratio of the engine can be varied. Referring to FIG. 1A–1B, 2 and 3, the cylinder receiving section 2 of the engine is mounted on the crankcase section 4 of the engine so that it can be laterally inclined, the crankshaft 6 being mounted in this crankcase section. To enable the cylinder receiving section to be tilted or inclined laterally a tilting shaft bearing 8 is arranged on one side of the engine.

Alternative positions of this tilting shaft bearing 8 between the cylinder receiving section and the crankcase section are shown in FIGS. 1 A–1B, 2 and 3.

Figure 1A:
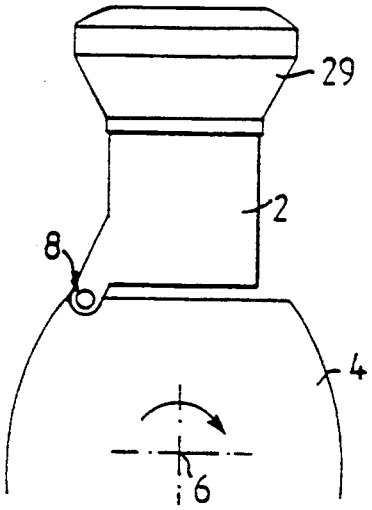
FIG. 1 A–B.
Figure 1B:
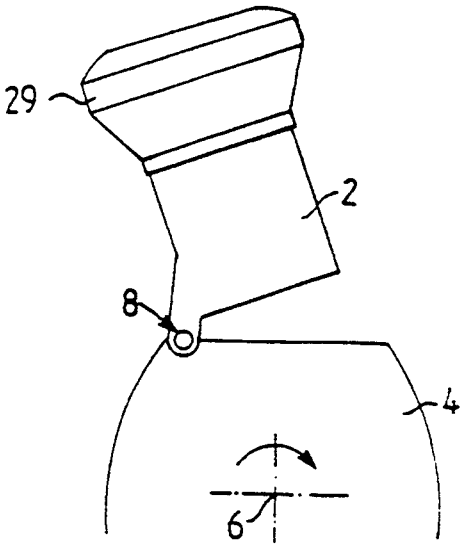
Figure 2:
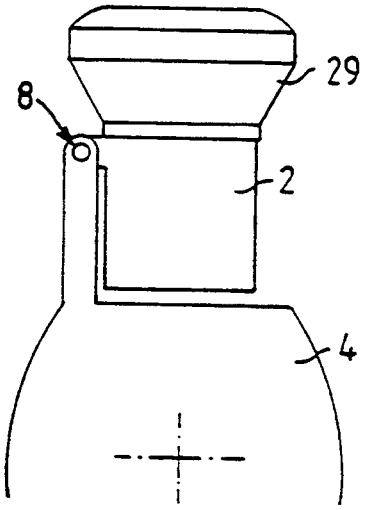
FIG. 2 and FIG. 3 show diagrammatic end views of internal combustion engines with variable compression provided by the tiltable mounting of the cylinder receiving section on the crankcase section.
Figure 3:
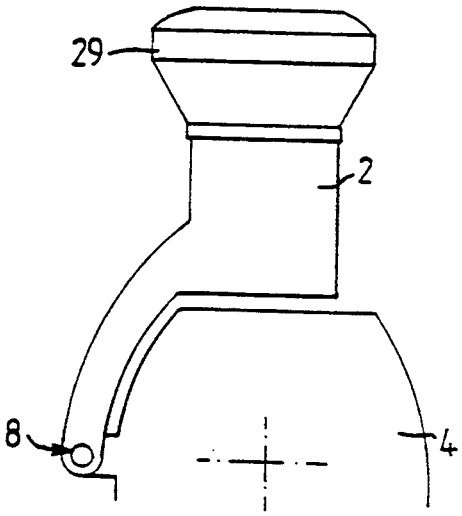

FIGS. 1A–1B show the tilting shaft positioned on the lower edge of the cylinder receiving section;

FIG. 2 shows the tilting shaft located on the upper edge of the cylinder receiving section, and FIG. 3 shows the tilting shaft located on the side of the lower part of the crankcase section, level with the crankshaft. For the engines according to FIGS. 1A, 1B, 2 and 3 it is generally the case that the cylinder receiving section 2 may either be integral with the associated cylinder head 29, or may be removably connected to the cylinder head by detachable, bolted or screwed joints.

Below reference is made chiefly to FIGS. 4–7, which show engine designs in which the tilting shaft is positioned as shown in FIGS. 1A–1B.

The engine shown has a cylinder receiving section 2 (with four cylinders 10, see FIG. 6) and a crankshaft section 4, in which crankshaft 12 is mounted. In each cylinder 10 there is a moving piston 14, which is connected by a connecting rod 16 to a crank journal section of crankshaft 12. On the bottom of crankshaft section 4 there is also an oil sump, but this is not shown in the figures.

Figure 4:
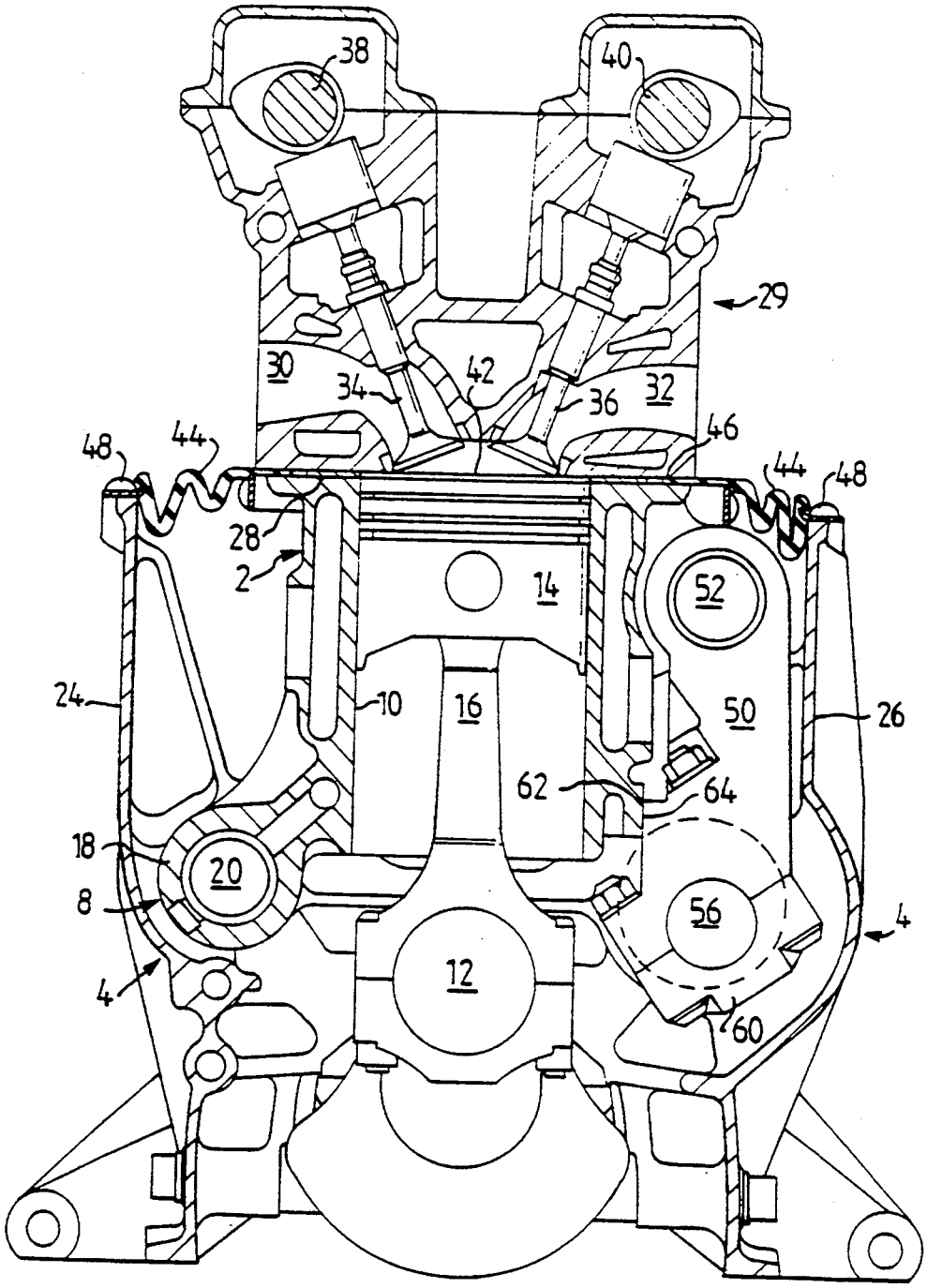
FIG. 4 shows a vertical section through an engine of the type shown in FIG. 1A–1B, in a position for maximum compression.
Figure 5:
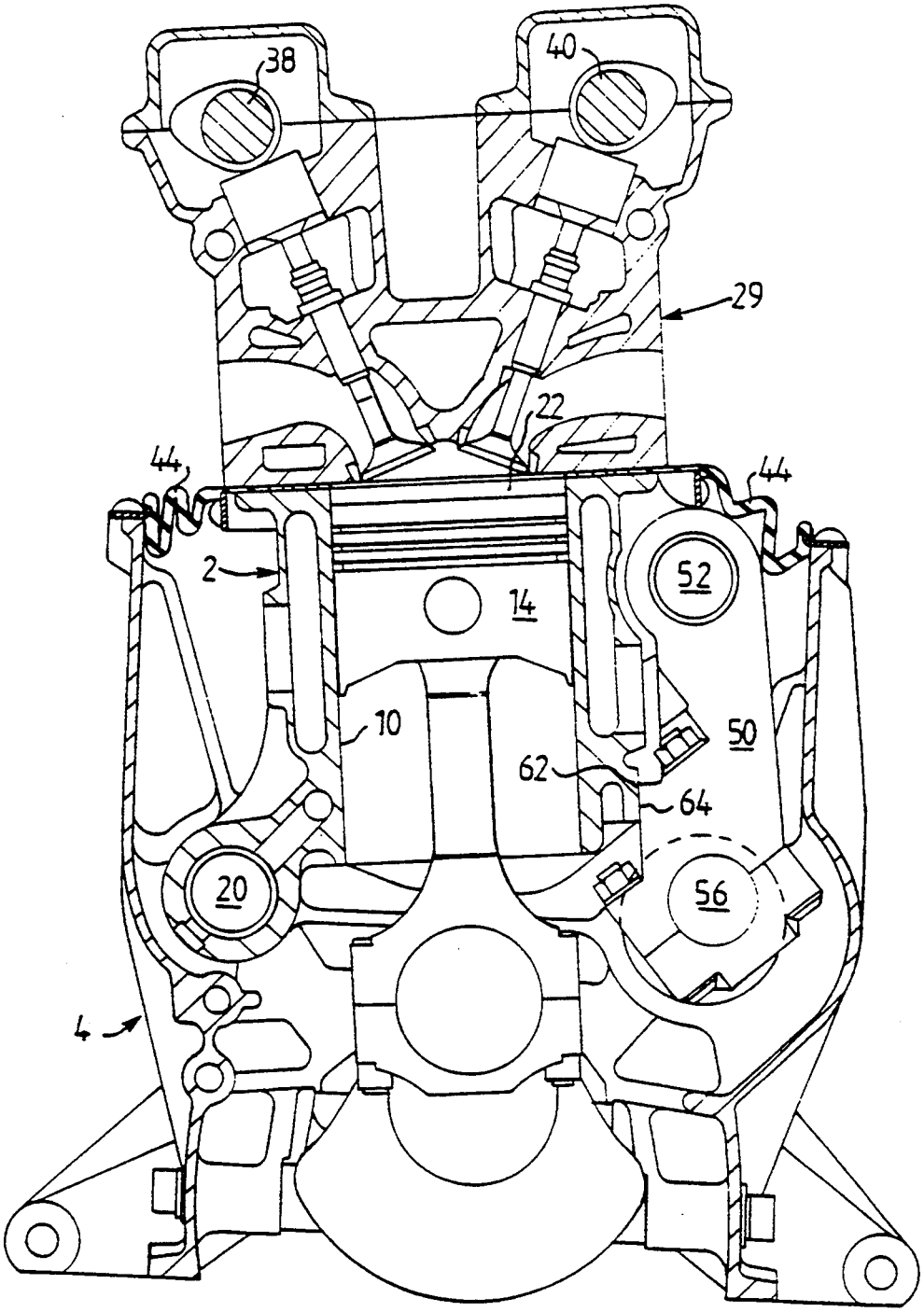
FIG. 5 shows the engine according to FIG. 4 in a position with maximum lateral inclination of the cylinder section for minimum compression.

At the bottom, on one size, the cylinder receiving section 2 has four bearing lugs 18 (only one is shown in FIGS. 4, 5) through which is passed a tilting or lateral inclination shaft 20, mounted in five bearing brackets connected to crankcase section 4, the middle three of which are located between bearing lugs 18, and the two outermost receiving the ends of shaft 20. This tilting shaft bearing arrangement allows tilting (inclination) of the cylinder receiving section 2 relative to crankcase section 4, about shaft 20. Because crankshaft 12 is mounted in crankcase section 4, and pistons 14 are connected to the crankshaft, whilst section 2 can be swivelled away from the crankshaft by lateral inclination, cylinders 10 can be displaced a short distance obliquely upwards/outwards relative to pistons 14. This relative movement between each piston and the associated cylinder therefore gives rise to a certain lowering or pulling down of the piston in the cylinder, which causes excess volume 22 in the combustion chamber above piston 14 when the piston is in the upper dead centre position shown in FIG. 5. This results in a reduced compression ratio compared to that applicable to the mutual position of the engine parts 2, 4 shown in FIG. 4.

Crankcase section 4 also has raised lateral walls 24, 26 which extend approximately to the level of the upper limiting surface 28 of section 2. At the front and rear end of the engine there is also a gear case and end plate (not shown) which form the front and rear end wall of crankcase section 4 respectively, and which connect lateral walls 24, 26 together. The gear case and end plate; also end at essentially the same level as that on which surface 28 is located. The upper limiting surfaces of walls 24, 26, the gear case and the end plate therefore lie in the same plane, corresponding essentially to limiting surface 28. The cylinder receiving section 2 is therefore surrounded by walls on all sides. Lateral walls 24, 26 need not necessarily be integral with crankcase section 4, but may instead constitute separate wall sections mounted on section 4.

A cylinder head 29, with inlet and outlet ducts 30, 32, inlet and outlet valves 34, 36, and overhead camshafts 38, 40, is secured to surface 28 of the cylinder receiving section 2. Normal arrangements (not shown), such as inlet and outlet system and apparatus for fuel injection, supercharging and exhaust cleaning, are also connected to the inlet and outlet ducts. Between cylinder head 29 and the cylinder receiving section 2 there is a cylinder head gasket 42, and between section 2 and lateral walls 24, 26, and the gear case and end plate, is arranged an elastic seal 44, which extends around the entire periphery of section 2 and serves to seal the engine crankcase. The seal is designed so that it can move, be bent upwards and downwards, and assume different vertical positions in different areas. The inner edge 46 of the seal is tightly clamped between cylinder head 29 and the cylinder receiving section 2. A plate edge is cast in at the outer edge of seal 44 and is secured by means of joints 48 so that it seals against the upper limiting surfaces of walls 24, 26, the gear case and end plate.

On the side of section 2 opposite tilting shaft 20 are arranged four rods 50, resembling connecting rods (see FIG. 6), whose upper ends are swivelled on a longitudinal shaft 52 mounted in five bearing brackets 54 connected to the cylinder receiving section 2. At the lower ends rods 50 are eccentrically mounted on an eccentric shaft 56 which is in turn mounted in five bearing brackets 58 secured to the crankcase section. The outermost bearing brackets 54 are located at the ends of section 2, and the other three are located in the transverse plane areas between cylinders 10, where section 2 exhibits a high degree of rigidity. At the lower ends rods 50 have bearing caps 60 for simple assembly/removal of the rod ends on and from shaft 56. Eccentric shaft 56 is connected to an arrangement (not shown) with which shaft 56 can be rotated to vary the lateral inclination of section 2, and hence the compression ratio of the engine. On the side of the cylinder receiving section 2 there are stop faces 62 for lateral surfaces 64 on rods 50, so that surfaces 64 rest against faces 62 in both rotary limit positions of eccentric shaft 56, corresponding to the minimum and maximum compression ratios of the engine.

Figure 6:
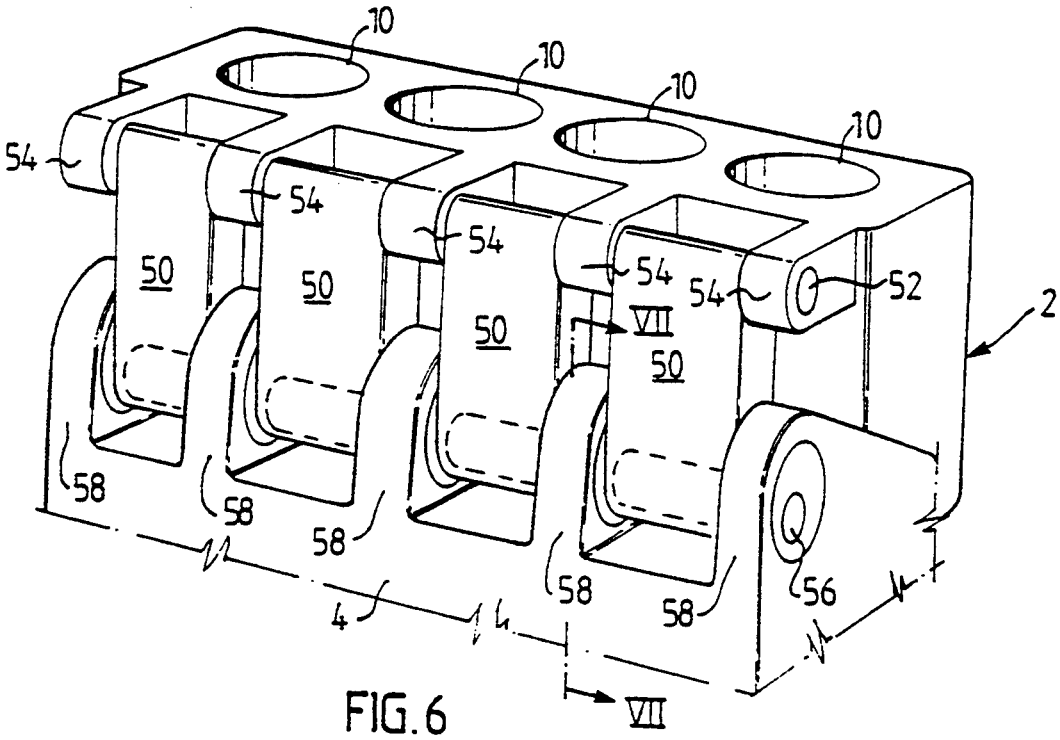
FIG. 6 shows diagrammatically, in perspective, the essential elements of the tilting mechanism for raising/-lowering the right-hand side of the engine according to FIGS. 4–5.
Figure 7:
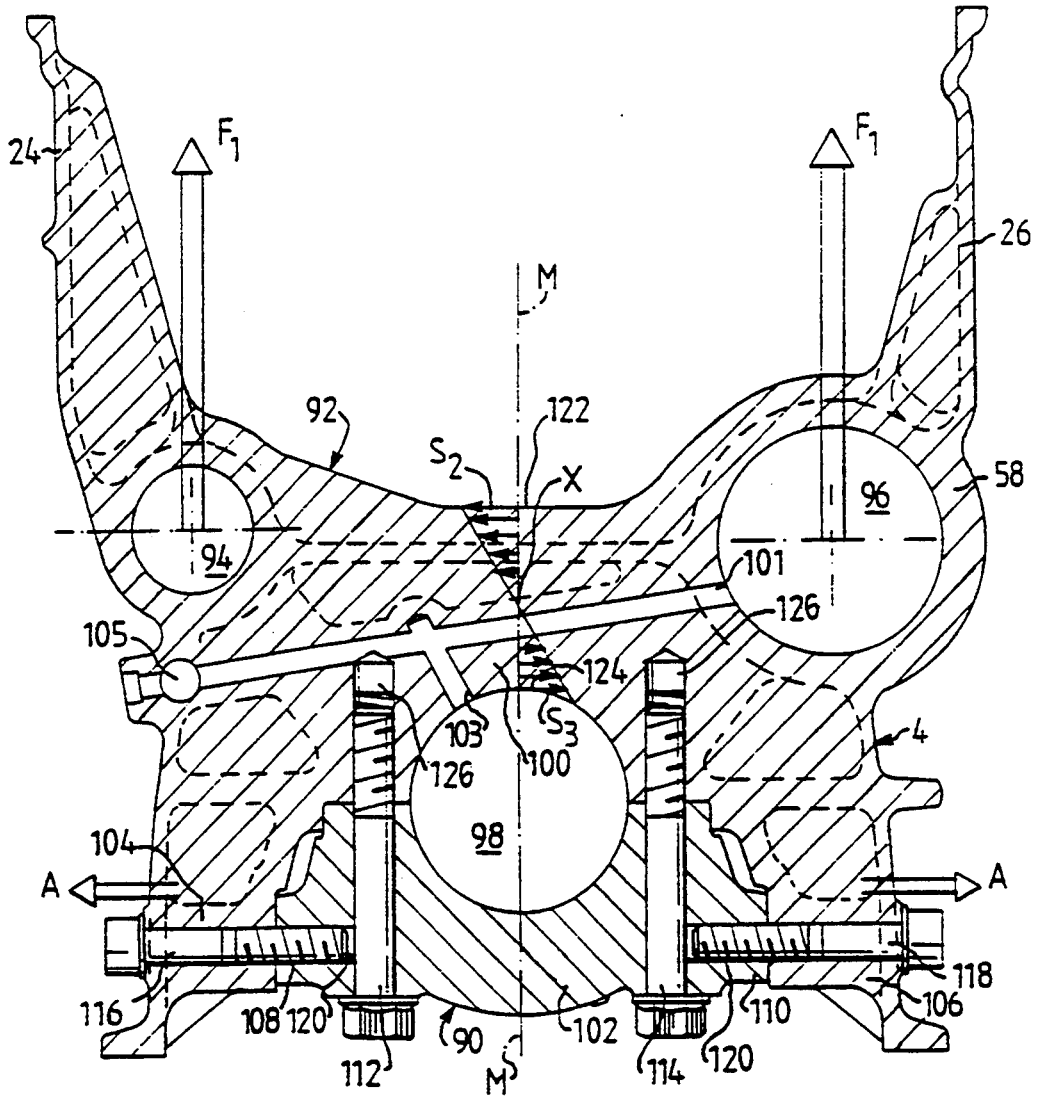
FIG. 7, finally, shows a vertical section only through the crankcase section of an engine according to the invention, the section having been made centrally through a crankshaft bearing.

We shall now study more closely the actual crankcase section 4 of an internal combustion engine of the type shown in FIGS. 1A–1B and FIGS. 4–6, with particular reference to FIG. 7, which shows a vertical section at the point of intersection denoted in FIG. 6 by VII—VII.

The cross-section in question, shown in FIG. 7, is therefore made through crankcase section 4 of the engine, in the centre of a pair of bearing brackets 54 and 58 located in the same transverse plane of the engine, and a bearing bracket located in this transverse plane and arranged on the opposite side of the engine, between a pair of bearing lugs 18 adjacent to each other. The cross-section shown also apparently passes through the centre of one of cranshaft bearings 90 of the engine in the lower region of crankcase section 4.

In other words the sectional area shown in FIG. 7 is located in the centre of one of the transverse frames 92 (or bearing bracket sections) discussed above in the general part of the description. In the opposing lateral areas of transverse frame 92 there are continuous cylindrical ports 94 and 96 for inclination shaft (tilting shaft) 20 and eccentric shaft 56. The port for crankshaft 12 of the engine is denoted by 98 and is limited in the upward direction by the central section 100 of the crankshaft cradle and in the downward direction by bearing cap 102 of the crankshaft bearing, which can be mounted from underneath. In crankshaft section 4 there are transverse lubricating oil ducts 101 and 103 for the bearing port 96 (for shaft 56) of the tilting mechanism and for crankshaft port 98. These oil ducts are branches of an axial lubricating oil duct 105.

Bearing cap 102 for the, crankshaft bearing shown in FIG. 7 is designed as a continuous transverse connecting element which extends between the lower lateral part 104 and 106 of crankshaft section 4. These lateral parts 104, 106 therefore constitute lower sections of the crankshaft cradle. Crankshaft bearing cap 102 is therefore designed so that its outer ends 108 and 110 rest directly against internal areas of the surface of lateral parts 104, 106.

Bearing cap 102 is secured by conventional means in crankshaft section 4 by means of vertical crankshaft bearing screws 112, 114, which extend through unthreaded holes in the bearing cap and are screwed into threaded bottom holes 126 on the sides of crankshaft port 98. Moreover, bearing cap 102 is secured in the lower lateral parts 104, 106 of the crankshaft section by means of horizontal screws 116, 118 which extend through unthreaded holes in these lateral parts and are screwed into threaded holes 120 at the outer ends 108, 110 of the bearing cap. To ensure that the absorption, and transmission of forces in and through the screws on bearing cap 102 are as favorable as possible the crankshaft bearing screws 112, 114 and fixing screws 116, 118 are located in a common vertical plane perpendicular to the crankshaft.

We shall now briefly study the loading forces and moments which act on crankshaft section 4 because of the combustion in the engine cylinders, and in particular on the transverse frame (or bearing bracket section) 92 shown in FIG. 7. It is these particular forces and moments, and the resultant deflections, which this invention is intended to deal with (i.e. counteract) in such a manner that undesirably large dimensions of the crankcase section can be avoided.

During the combustion in engine cylinders 10 the cylinder receiving section 2, tiltably mounted in crankcase section 4, will apply to crankcase section 4 upwardly directed tensile forces $F_1$ which, as shown in FIG. 7, may be considered to attack the centre of ports 94 and 96 for tilting shaft 20 and eccentric shaft 56.

Now if we imagine for one moment that the horizontal fixing screws 116, 118 of bearing cap 102 are missing, it can readily be seen that forces $F_1$ produce a bending moment in the "transverse beam area" of transverse frame 92 between ports 94, 96 and 98. This bending moment caused by forces $F_1$ gives rise to maximum compressive and bending stresses in longitudinal centre plane M of the engine. The distribution of stresses in central section 100, in plane M, will then be the classic distribution, shown in FIG. 7, with maximum compressive stresses $S_2$ at the upper limit 122, and maximum tensile stresses $S_3$ at the lower limit 124 (in the "roof" of crankcase port 98).

Of these stresses, those last mentioned are the most critical because it is these stresses which are decisive for dimensioning section 100. To avoid excessive stresses of this kind in the material the "web or beam height" between limits 122 and 124 must be made large, resulting in an undesirably large design height of the crankcase section and hence of the entire engine.

In addition to these dimensioning problems relating to area 100, forces $F_1$ also result in undesirably large lateral deflections (in the directions of arrows A) of the lower lateral parts 104, 106 of crankcase section 4-still assuming the absence of fixing screws 116, 118.

Based on this clear illustration it may be stated that point X (midway between limits 122 and 124) will be a kind of "fulcrum" in the transverse frame or bearing bracket section 92, in the absence of screws 116, 118 or corresponding alternative screwed joints acting in the horizontal direction.

The basic concept of the invention is now to provide transverse reinforcement or stiffening in the lower region of crankcase section 4, reducing bending stress and counteracting deflection, particularly in the area of the bearing cap 102 of the crankshaft bearing, which can be mounted from underneath. The special design of the crankshaft bearing cap, combined with the horizontal fixing screws 116, 118, provide by simple means the stiffening of crankcase section 4 required, and as described above. Screws 116 and 118 therefore bring about a contraction of the entire crankcase section 4 to form a closed structure around crankshaft 12. This contraction of the crankcase section gives rise to a considerable reduction in the maximum compressive and tensile stresses $S_2$ and $S_3$ respectively caused by forces $F_1$. The horizontal screws 116 and 118, combined with bearing cap 102, designed as a continuous transverse connecting element, provide a closed structure of the crankcase section and crankshaft cradle which is favorable from the point of the flow of forces. The stresses in the plane of symmetry M will therefore be considerably lower than would be the case with a conventional crankshaft bearing cap without lateral anchoring. In this connection it should be observed, in particular, that the stresses in plane M are critical in dimensioning the parts of the crankcase section located in this area.

We claim:

1. An internal combustion engine having a variable compression ratio, which comprises:

a crankcase section having upper and lower portions, the lower portion having opposed lateral parts having respective first and second opposed inner surfaces;

a cylinder section pivotally mounted on the crankcase section at the upper portion thereof via an inclination shaft and an eccentric shaft, the pivotal mounting of the cylinder section allowing variation of the compression ratio and subjecting the crankcase section to high compressive and bending stresses;

a crankshaft;

bearing means for mounting the crankshaft to the crankcase section at the lower portion thereof between the opposed inner surfaces of the opposed lateral parts, the bearing means including bearing cap means located beneath the crankshaft and extending transversely thereof to first and second end elements in full contact respectively with the first and second opposed inner surfaces of the opposed lateral parts of the lower portion of the crankcase section so as to provide a closed structure of the crankcase section and the bearing cap means;

vertically extending fastening means for securing the bearing cap means to the crankcase section; and horizontally extending fastening means for reinforcing the crankcase section to compensate for the high compressive and bending stresses resulting from the pivotal mounting of the cylinder section by fastening first and second opposed inner surfaces of the lateral parts of the lower portion of the crankcase section.

2. An internal combustion engine according to claim 1, wherein the bearing means includes a plurality of bearings and the bearing cap means includes a plurality of bearing caps which are respectively associated with respective ones of the plurality of bearings.

3. An internal combustion engine according to claim 2, wherein the vertical fastening means includes a plurality of screws.

4. An internal combustion engine according to claim 2, wherein the horizontal fastening means includes a plurality of screws.

5. An internal combustion engine according to claim 2, wherein: the lateral parts have a plurality of pairs of unthreaded holes, one pair for each of the plurality of bearing caps, each unthreaded hole being aligned with its associated bearing cap and extending from an outer surface of one of the lateral parts to one of the opposed inner surfaces thereof, each unthreaded hole in the first lateral part being coaxial with one of the unthreaded holes in the second lateral part; and the horizontal fastening means includes respective screws received in each unthreaded hole and extending into a threaded hole in the associated bearing cap.

6. An internal combustion engine according to claim 2, wherein the vertical fastening means includes a pair of screws for each bearing cap, the horizontal fastening means includes a pair of screws for each bearing cap extending opposingly from each lateral part of the lower portion of the crankcase section to its respective bearing cap, the horizontal and vertical screws for each bearing cap lying in a common plane perpendicular to the crankshaft.

* * * * *